US009535386B2

(12) United States Patent
Umimura

(10) Patent No.: US 9,535,386 B2
(45) Date of Patent: Jan. 3, 2017

(54) IMAGE FORMING APPARATUS WITH FIRST AND SECOND POWER SUPPLY

(71) Applicant: CANON KABUSHIKI KAISHA, Tokyo (JP)

(72) Inventor: Kiyokazu Umimura, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/884,657

(22) Filed: Oct. 15, 2015

(65) Prior Publication Data

US 2016/0033913 A1 Feb. 4, 2016

Related U.S. Application Data

(63) Continuation of application No. 14/312,539, filed on Jun. 23, 2014, now Pat. No. 9,188,936.

(30) Foreign Application Priority Data

Jun. 28, 2013 (JP) ..... 2013-136174

(51) Int. Cl.
*G03G 15/00* (2006.01)

(52) U.S. Cl.
CPC ..... *G03G 15/5004* (2013.01); *G03G 15/80* (2013.01)

(58) Field of Classification Search
CPC ..... G03G 15/80; G03G 15/5004; G03G 2215/00978
USPC ..... 399/37, 88
See application file for complete search history.

(56) References Cited

U.S. PATENT DOCUMENTS

| | | | | |
|---|---|---|---|---|
| 8,265,512 | B2 * | 9/2012 | Endo | G03G 15/2039 399/88 |
| 2006/0177236 | A1 * | 8/2006 | Kowari | G03G 15/5004 399/88 |
| 2008/0224540 | A1 * | 9/2008 | Sugawara | G03G 15/80 307/46 |
| 2013/0195497 | A1 * | 8/2013 | Shimura | G03G 15/80 399/88 |
| 2014/0072323 | A1 * | 3/2014 | Yamamizu | G03G 15/5004 399/88 |

(Continued)

FOREIGN PATENT DOCUMENTS

| | | | |
|---|---|---|---|
| JP | 2001195804 A | * | 7/2001 |
| JP | 2008023218 A | * | 2/2008 |

(Continued)

*Primary Examiner* — Robert Beatty
(74) *Attorney, Agent, or Firm* — Canon U.S.A., Inc. IP Division

(57) ABSTRACT

An image forming apparatus includes a first power supply unit configured to generate first output power, a second power supply unit configured to generate second output power, a switching unit disposed on the primary side of the second power supply unit, a monitoring unit configured to monitor the second output power generated by the second power supply unit, a power source control unit supplied with the first output power, and configured to turn the switching unit ON or OFF, and a control unit supplied with the first output power, and configured to control operations of the power source control unit. When the second output power is lower than a threshold value, the power source control unit turns the switching unit OFF and then back to ON in a state where the first output power generated by the first power supply unit is supplied to the control unit.

12 Claims, 9 Drawing Sheets

(56) References Cited

U.S. PATENT DOCUMENTS

| | | | | |
|---|---|---|---|---|
| 2014/0198337 | A1* | 7/2014 | Nakajima | G06K 15/4055 358/1.14 |
| 2014/0313537 | A1* | 10/2014 | Imoto | G06F 3/1221 358/1.14 |
| 2015/0003850 | A1* | 1/2015 | Umimura | G03G 15/5004 399/37 |

FOREIGN PATENT DOCUMENTS

| | | | |
|---|---|---|---|
| JP | 2009213042 | A * | 9/2009 |
| JP | 2011224865 | A * | 11/2011 |

* cited by examiner (1) POWER SWITCH IS TURNED OFF.
(2) POWER SWITCH IS TURNED ON.
(3) PDL PRINT JOB IS RECEIVED.
(4) PACKET (TO WHICH PROXY RESPONSE IS NOT POSSIBLE) IS RECEIVED, OR ANY OF BUTTONS 121 OF OPERATION UNIT 12 IS PRESSED.
(5) PREDETERMINED TIME HAS ELAPSED WITHOUT OPERATION OF BUTTONS 121, AND PREDETERMINED TIME HAS ELAPSED WITHOUT RECEPTION OF PDL PRINT JOB.
(6) POWER SAVING BUTTON 121C OF BUTTONS 121 IS PRESSED.

FIG.5

| | POWER SOURCE CONTROL UNIT | RAM | LAN CONTROLLER | OPERATION UNIT (BUTTONS) | CPU | ROM | HDD | OPERATION UNIT (DISPLAY UNIT) | IMAGE PROCESSING UNIT | PRINTER IMAGE PROCESSING UNIT | SCANNER IMAGE PROCESSING UNIT | PRINTER CONTROL UNIT | PRINTER DRIVE UNIT | SCANNER CONTROL UNIT | SCANNER DRIVE UNIT |
|---|---|---|---|---|---|---|---|---|---|---|---|---|---|---|---|
| POWER OFF STATE | OFF | OFF | OFF | OFF | OFF | OFF | OFF | OFF | OFF | OFF | OFF | OFF | OFF | OFF | OFF |
| SUSPEND STATE | ON | ON | OFF | OFF | OFF | OFF | OFF | OFF | OFF | OFF | OFF | OFF | OFF | OFF | OFF |
| SECOND SLEEP STATE | ON | ON | ON | ON | OFF | OFF | OFF | OFF | OFF | OFF | OFF | OFF | OFF | OFF | OFF |
| FIRST SLEEP STATE | ON | ON | ON | ON | ON | ON | ON | OFF | OFF | OFF | OFF | OFF | OFF | OFF | OFF |
| STANDBY STATE | ON | ON | ON | ON | ON | ON | ON | ON | ON | ON | ON | ON | ON | ON | ON |

IMAGE FORMING APPARATUS WITH FIRST AND SECOND POWER SUPPLY

CROSS REFERENCE TO RELATED APPLICATIONS

The present application is a continuation of U.S. patent application Ser. No. 14/312,539, filed Jun. 23, 2014, entitled "IMAGE FORMING APPARATUS WITH FIRST AND SECOND POWER SUPPLY", the content of which is expressly incorporated by reference herein in its entirety. Further, the present application claims priority from Japanese Patent Application No. 2013-136174 filed Jun. 28, 2013, which is also hereby incorporated by reference herein in its entirety.

BACKGROUND OF THE INVENTION

Field of the Invention

The present invention relates to an image forming apparatus including a monitoring unit for monitoring an output voltage.

Description of the Related Art

An image forming apparatus is known which includes a monitoring unit for monitoring a power failure and an instantaneous voltage drop (brownout) (Japanese Patent Application Laid-Open No. 2009-213042). The image forming apparatus discussed in Japanese Patent Application Laid-Open No. 2009-213042 includes a power monitoring unit for detecting a power failure and an instantaneous voltage drop based on a drop of an input voltage. The power monitoring unit is an electrical circuit which outputs a predetermined signal to a controller if the input voltage falls below a predetermined threshold value. When a central processing unit (CPU) of the controller receives the above-described predetermined signal from the power monitoring unit, the CPU executes initialization processing on the image forming apparatus, and then sets the image forming apparatus in a state where power supply is stopped, i.e., a plug is disconnected from alternating current (AC) power. Then, when power is supplied to the CPU of the controller, the CPU supplied with the relevant power executes activation processing.

In the above-described image forming apparatus discussed in Japanese Patent Application Laid-Open No. 2009-213042, if a power failure occurs, power supply to the controller is once stopped. Therefore, since processing for activating the controller is required to restore the image forming apparatus, it takes time until the image forming apparatus returns to an operable state even after the power failure is resolved.

SUMMARY OF THE INVENTION

The present invention is directed to providing an image forming apparatus capable of resolving a power failure without stopping power supply to a control unit.

According to an aspect of the present invention, an image forming apparatus includes a first power supply unit configured to generate first output power, a second power supply unit configured to generate second output power, a switch disposed on the input side of the second power supply unit, and a monitoring unit configured to monitor the second output power generated by the second power supply unit, a power source control unit supplied with the first output power generated by the first power supply unit, and configured to turn the switch ON or OFF, and a control unit supplied with the first output power generated by the first power supply unit, and configured to control operations of the power source control unit. When the power source control unit determines that the second output power generated by the second power supply unit is lower than a threshold value based on the result of the monitoring by the monitoring unit, the power source control turns the switch OFF and then, after a predetermined time period has elapsed, back to ON while maintaining a state where the first output power generated by the first power supply unit is supplied to the control unit.

Further features of the present invention will become apparent from the following description of exemplary embodiments with reference to the attached drawings.

BRIEF DESCRIPTION OF THE DRAWINGS

FIG. 5 is a table illustrating device statuses in each power state.

DESCRIPTION OF THE EMBODIMENTS

Various exemplary embodiments, features, and aspects of the invention will be described in detail below with reference to the drawings.

<Overall Configuration of Image Forming Apparatus>

Figure 1:
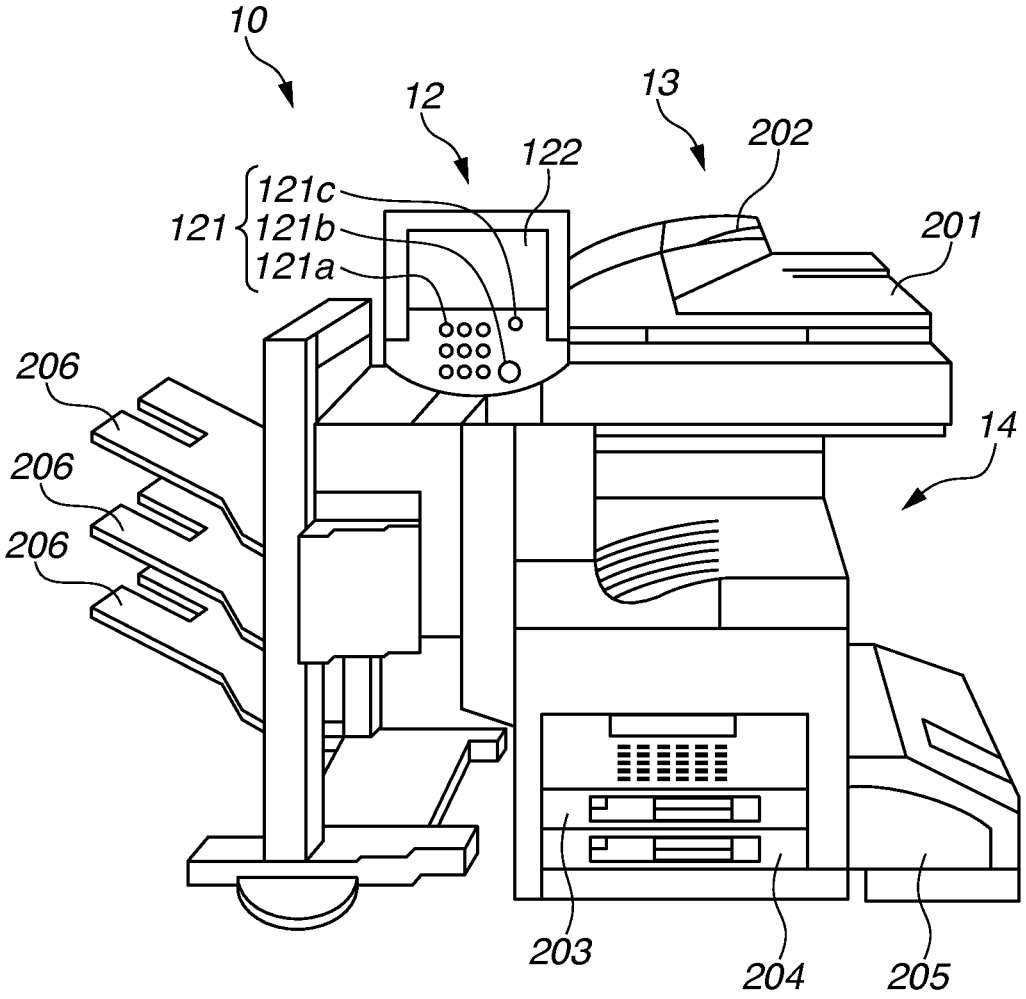
FIG. 1 is a perspective view illustrating an image forming apparatus according to a first exemplary embodiment.

FIG. 1 is an external view illustrating an image forming apparatus according to a first exemplary embodiment of the present invention.

As illustrated in FIG. 1, an image forming apparatus 10 includes an operation unit 12 as a user interface (UI), a scanner unit 13 as an image input device, and a printer unit 14 as an image output device.

The operation unit 12 is provided with various buttons 121 operated by a user, and a display unit 122 for image display. The display unit 122 displays a status screen for displaying statuses of the image forming apparatus 10, and a setting screen for inputting information required to perform copy and facsimile functions. The buttons 121 include a button 121*a* for inputting the number of copies, a start button 121*b* for starting copy and fax transmission, and a power saving button 121*c* for shifting the image forming apparatus 10 to the power saving state (first sleep state (described below)).

The scanner unit 13 reads an image formed on a document, and acquires image data. The scanner unit 13 inputs into a charge coupled device (CCD) reflected light of the light radiated onto the image formed on the document to convert information on the relevant image into an electrical signal, converts the electrical signal into a luminance signal which is composed of R, G, and B colors, and outputs the signal to a controller 11 (described below).

The document to be read by the scanner unit 13 is set on a tray 202 of a document feeder 201. When the user inputs an instruction for starting document reading by using the operation unit 12, the scanner unit 13 feeds each document sheet from the tray 202 of the document feeder 201, and performs a document read operation. Instead of automatic feeding by the document feeder 201, a carriage mounted with a light source and a CCD may scan a document sheet placed on a glass plate (not illustrated).

The printer unit 14 forms an image on a sheet by using the input image data. Although, in the present exemplary embodiment, the printer unit 14 performs image formation based on the electrophotographic process using a photosensitive drum and a photosensitive belt, the present invention is not limited thereto. For example, the printer unit 14 may employ the ink-jet process in which ink is discharged from a minute nozzle array to print an image on a sheet.

The image forming apparatus 10 is provided with a plurality of paper cassettes 203, 204, and 205 for storing sheets on which an image is to be formed by the printer unit 14. The image forming apparatus 10 is further provided with a plurality of sheet discharge trays 206 onto which sheets having an image formed thereon by the printer unit 14 are discharged.

<Descriptions of Controller 11 of Image Forming Apparatus 10>

The controller 11 for controlling overall operations of the image forming apparatus 10 will be described below with reference to FIG. 2.

Figure 2:
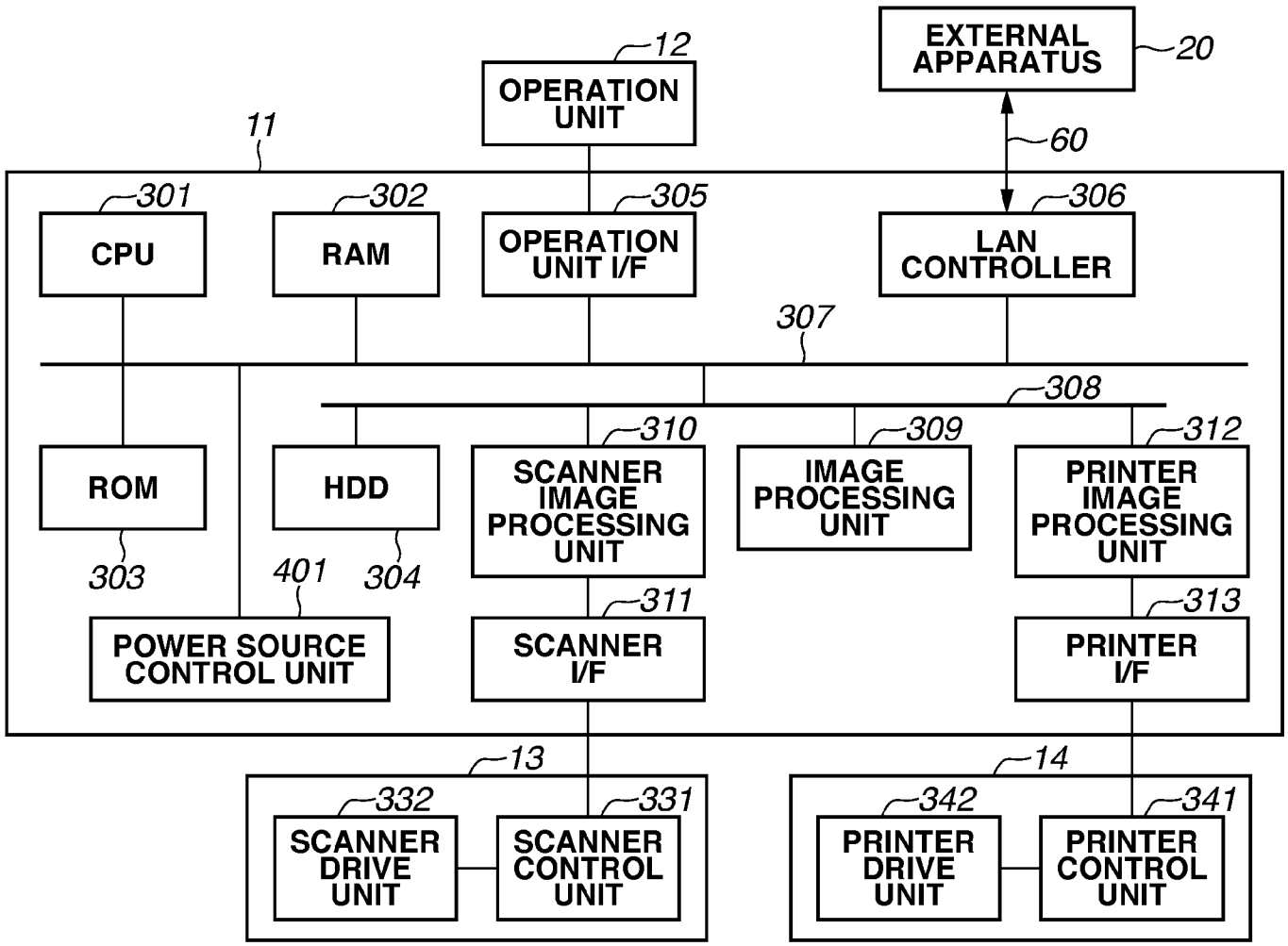
FIG. 2 is a block diagram illustrating a controller of the image forming apparatus.

As illustrated in FIG. 2, the controller 11 is electrically connected with the above-described scanner unit 13, the printer unit 14, and the operation unit 12. The controller 11 includes a CPU 301, a random access memory (RAM) 302, a read only memory (ROM) 303, an operation unit I/F 305, a local area network (LAN) controller 306, and a power source control unit 401. The CPU 301, the RAM 302, the ROM 303, the operation unit I/F 305, the LAN controller 306, and the power source control unit 401 are connected to a system bus 307. The controller 11 further includes a hard disk drive (HDD) 304, an image processing unit 309, a scanner image processing unit 310, and a printer image processing unit 312. The HDD 304, the image processing unit 309, the scanner image processing unit 310, and the printer image processing unit 312 are connected to an image bus 308.

The CPU 301 totally controls access to various devices connected thereto based on a control program stored in the ROM 303, and also totally controls various processing executed by the controller 11.

The RAM 302 serves as a system work memory required for operations of the CPU 301, and is also used to temporarily store image data. The RAM 302 includes a static RAM (SRAM) that can retain its contents even when power is turned OFF, and a dynamic RAM (DRAM) that will lose its contents when power is turned OFF. The ROM 303 stores a boot program of the image forming apparatus 10. The HDD 304 stores system software and image data.

The operation unit I/F 305 connects the system bus 307 and the operation unit 12. The operation unit I/F 305 receives from the system bus 307 image data to be displayed on the operation unit 12, outputs the image data to the operation unit 12, and outputs to the system bus 307 information input from the operation unit 12.

The LAN controller 306 controls information input and output between the image forming apparatus 10 and the external apparatus 20 connected to a LAN 60.

The power source control unit 401 controls power supply to each unit of the image forming apparatus 10. The power source control unit 401 will be described in detail below.

The image bus 308 is a transmission line for transmitting and receiving image data, and is composed of a peripheral component interconnect (PCI) bus or an IEEE1394 bus.

The image processing unit 309 performs image processing. Specifically, it reads image data stored in the RAM 302, and performs image processing, such as JPEG/JBIG enlargement/reduction processing and color adjustment, on the image data. The scanner image processing unit 310 receives image data from the scanner unit 13 via the scanner I/F 311, and performs correction, processing, and editing on the image data. The scanner image processing unit 310 determines whether the received image data is a color document, a monochrome document, a text document, or a photographic document, and appends the result of the determination to the image data. Such additional information is referred to as attribute data. The printer image processing unit 312 performs image processing on the image data referring to the attribute data appended to the image data. After completion of image processing, the printer image processing unit 312 outputs the processed image data to the printer unit 14 via the printer I/F 313.

The scanner unit 13 includes a scanner control unit 331 and a scanner drive unit 332. The scanner drive unit 332 includes a sheet conveyance motor for conveying a document set on the tray 202 to the reading position of the scanner unit 13, and physically drives the scanner unit 13. The scanner control unit 331 controls operations of the scanner drive unit 332. When performing scanner processing, the scanner control unit 331 receives setting information set by the user via communication with the CPU 301, and controls operations of the scanner drive unit 332 based on the relevant setting information.

The printer unit 14 includes a printer control unit 341 and a printer drive unit 342. The printer drive unit 342 includes a fixing unit and a sheet conveyance motor (not illustrated), and physically drives the printer unit 14. The printer control unit 341 controls operations of the printer drive unit 342. When performing print processing, the printer control unit 341 receives setting information set by the user via communication with the CPU 301, and controls operations of the printer drive unit 342 based on the relevant setting information.

<Descriptions of Power Source Unit 40 of Image Forming Apparatus 10>

Figure 3:
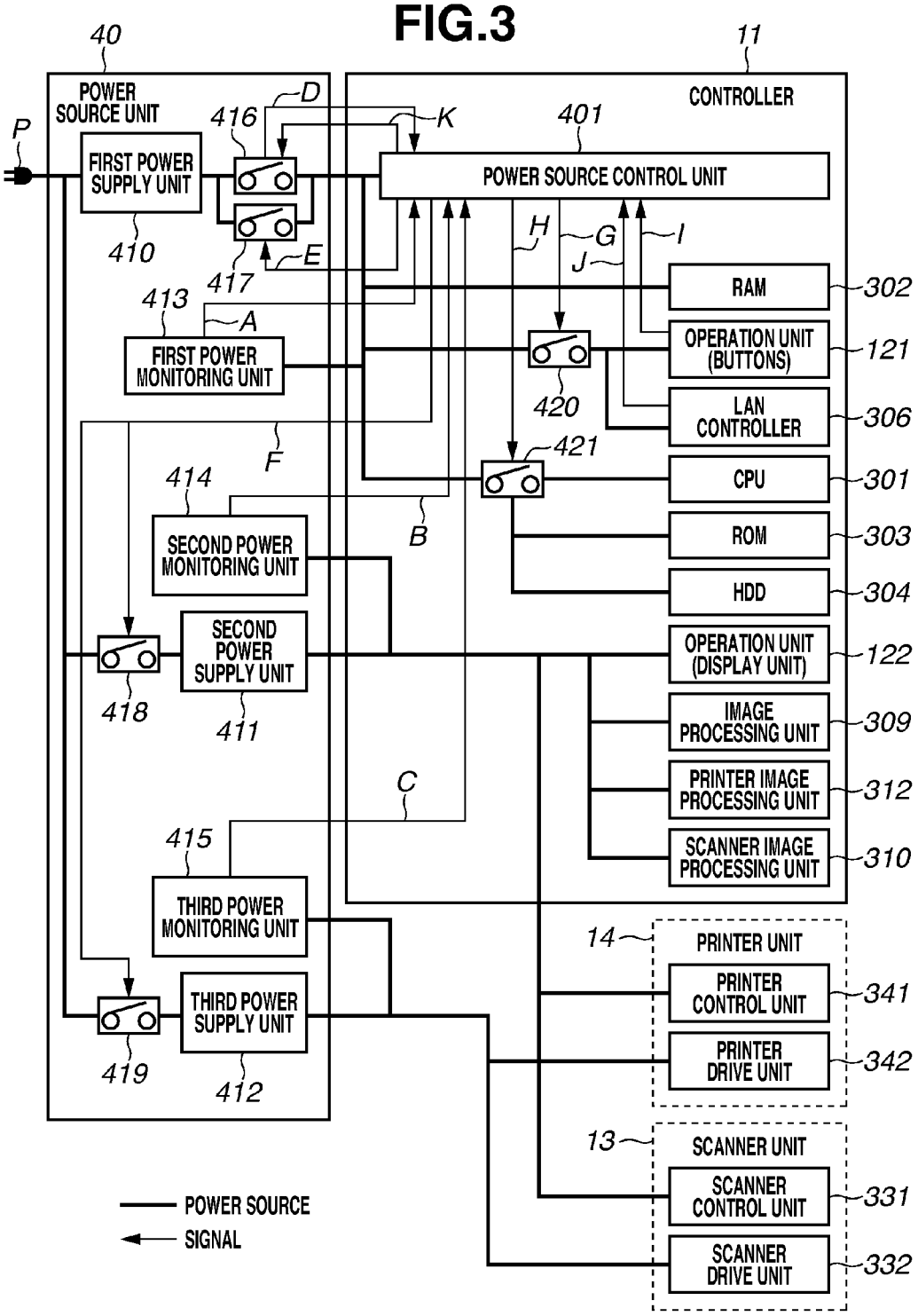
FIG. 3 is a power source circuit diagram of the image forming apparatus.

FIG. 3 is a power source circuit diagram of the image forming apparatus 10. Power generated by the power source unit 40 is supplied to each unit of the image forming apparatus 10. The power source unit 40 includes a first power supply unit 410, a second power supply unit 411, a third power supply unit 412, a first power monitoring unit 413, a second power monitoring unit 414, and a third power monitoring unit 415.

The first power supply unit 410 converts AC power supplied via a plug P into direct current (DC) power, for example, 5.1V (first output power). Then, the relevant DC power is supplied to devices of the first power supply system (the power source control unit 401, the CPU 301, the RAM 302, the ROM 303, the HDD 304, the LAN controller 306, and the buttons 121 of the operation unit 12). In the present exemplary embodiment, the CPU 301 operates on power supplied from the first power supply unit 410, without receiving power supplied from the second power supply unit 411 and the third power supply unit 412. This means that power of the CPU 301 is independent of the second power supply unit 411 and the third power supply unit 412. The second power supply unit 411 converts AC power supplied via the plug P into DC power, for example, 12V (second output power). The relevant DC power is supplied to devices of the second power supply system (the display unit 122 of the operation unit 12, the image processing unit 309, the scanner image processing unit 310, the printer image processing unit 312, the printer control unit 341 of the printer unit 14, and the scanner control unit 331 of the scanner unit 13). The third power supply unit 412 converts AC power supplied via the plug P into DC power (for example, 24V), and supplies power to devices of the third power supply system (the printer drive unit 342 and the scanner drive unit 332).

The first power monitoring unit 413 monitors the output voltage of the first power supply unit 410. When the first power monitoring unit 413 detects that the output voltage of the first power supply unit 410 exceeds a threshold value, the first power monitoring unit 413 outputs a power good signal A to the power source control unit 401 as a result of the monitoring.

The second power monitoring unit 414 monitors the output voltage of the second power supply unit 411. When the second power monitoring unit 414 detects that the output voltage of the second power supply unit 411 exceeds a threshold value, the second power monitoring unit 414 outputs a power good signal B to the power source control unit 401 as a result of the monitoring. The third power monitoring unit 415 monitors the output voltage of the third power supply unit 412. When the third power monitoring unit 415 detects that the output voltage of the third power supply unit 412 exceeds a threshold value, the third power monitoring unit 415 outputs a power good signal C to the power source control unit 401 as a result of the monitoring.

A power switch 416 which is turned ON or OFF by a user operation is provided between the first power supply unit 410 and devices of the first power supply system (the primary side of the first power supply unit 410). The power source control unit 401 receives a signal D which indicates the status (ON or OFF) of the power switch 416. A switch 417 including a field effect transistor (FET) is provided in parallel with the power switch 416. The switch 417 is turned OFF from ON or turned ON from OFF by a control signal E output from the power source control unit 401. The power switch 416 is provided with a solenoid (not illustrated). According to a control signal K output from the power source control unit 401, a voltage is applied to the solenoid and the power switch 416 is turned OFF.

A relay switch (switching unit) 418 is provided between the plug P and the second power supply unit 411 (the primary side of the second power supply unit 411). A relay switch 419 is provided between the plug P and the third power supply unit 412 (the primary side of the third power supply unit 412). The relay switches 418 and 419 are turned OFF from ON or turned ON from OFF by a control signal F output from the power source control unit 401.

A switch 420 is provided between the power switch 416 and the buttons 121 of the operation unit 12 and the LAN controller 306. A switch 420 is turned OFF from ON or turned ON from OFF by a control signal G output from the power source control unit 401. A switch 421 is provided between the power switch 416 and the CPU 301, the ROM 303, and the HDD 304. A switch 421 is turned OFF from ON or turned ON from OFF by a control signal H output from the power source control unit 401.

<Power States of Image Forming Apparatus 10>

Figure 4:
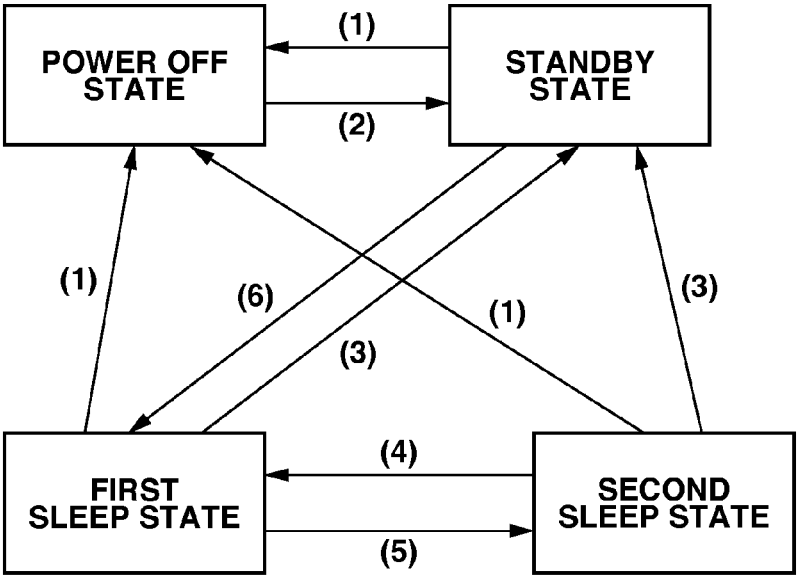
FIG. 4 is a power state transition diagram of the image forming apparatus.

FIG. 4 is a power state transition diagram of the image forming apparatus 10. FIG. 5 illustrates ON and OFF states of devices in each power state of the image forming apparatus 10. Power states of the image forming apparatus 10 will be described below with reference to FIGS. 4 and 5. The image forming apparatus 10 is in any one of the power OFF state, the first sleep state, the second sleep state, and the standby state.

The power OFF state is a state where each unit of the image forming apparatus 10 is not supplied with power. In the power OFF state, the switches 416 to 421 illustrated in FIG. 3 are OFF. The power OFF state may be the hibernation state. In the hibernation state, the switch 416 to 421 are OFF similar to the power OFF state. In the hibernation state, the state of the image forming apparatus 10 before shifting to the hibernation state is stored in the HDD 304. The image forming apparatus 10 can return from the hibernation state at high speed by using the information stored in the HDD 304.

The user presets whether the image forming apparatus 10 shifts to the power OFF state or to the suspend state when the power switch 416 is turned OFF. When the power switch 416 is turned OFF by a user operation, the image forming apparatus 10 shifts to the power OFF state or to the suspend state according to the above-described user setting. Specifically, when the power switch 416 is turned OFF by a user operation while the shift of the image forming apparatus 10 to the suspend state is set to be enabled by a user setting, the image forming apparatus 10 shifts to the suspend state. On the other hand, when the power switch 416 is turned OFF by a user operation while the shift of the image forming apparatus 10 to the suspend state is set to be disabled by a user setting, the image forming apparatus 10 shifts to the power OFF state.

In the second sleep state, power is supplied only to certain units of the image forming apparatus 10, i.e., the power source control unit 401, the RAM 302, the LAN controller 306, and the buttons 121 of the operation unit 12. In the second sleep state, the first power supply unit 410 supplies power to the power source control unit 401, the RAM 302, the LAN controller 306, and the buttons 121 of the operation unit 12. In the second sleep state, the switches 416, 417, and 420 illustrated in FIG. 3 are turned ON, and the other switches 418, 419, and 421 are turned OFF. In the second sleep state, the image forming apparatus 10 can receive user operations on the buttons 121 of the operation unit 12. In the second sleep state, the LAN controller 306 can receive a packet transmitted from the external apparatus 20. In the second sleep state, in lieu of the CPU 301 of the controller 11, the LAN controller 306 returns a response to a specific packet transmitted from the external apparatus 20. The relevant function of the LAN controller 306 is referred to as proxy response. When the LAN controller 306 performs proxy response, the image forming apparatus 10 can respond to a specific packet transmitted from the external apparatus 20 in the second sleep state (without returning from the sleep state).

The first sleep state is a state where the image forming apparatus 10 responds to an inquiry from a network 60 without activating all units of the controllers 11. In the second sleep state, when the image forming apparatus 10 receives from the external apparatus 20 a packet on which the LAN controller 306 cannot perform proxy response (such as an inquiry from the network 60), the image forming apparatus 10 shifts to the first sleep state from the second sleep state. In the first sleep state, power is supplied to the CPU 301 and the HDD 304 from the first power supply unit 410, and therefore the CPU 301 can return a response to the relevant packet by using the information stored in the HDD 304. In the first sleep state, power is supplied to the power source control unit 401, the RAM 302, the LAN controller 306, the buttons 121 of the operation unit 12, the CPU 301, the ROM 303, and the HDD 304. In the first sleep state, power is not supplied to devices of the second power supply system and devices of the third power supply system. In the first sleep state, the switches 416, 417, 420, and 421 illustrated in FIG. 3 is turned ON, and the switches 418 and 419 are turned OFF.

The standby state is a state where the power source control unit 401 can perform functions of the image forming apparatus 10, such as the print processing and the scanner processing. When the power switch 416 is turned ON from OFF in the power OFF state or the suspend state, the image forming apparatus 10 shifts to the standby state. When the image forming apparatus 10 receives a page description language (PDL) print job from the external apparatus 20 in the second sleep state, the image forming apparatus 10 also shifts to the standby state. In the standby state, power is supplied to the controller 11, the operation unit 12, the printer unit 14, and the scanner unit 13. Specifically, in the standby state, the switches 416 to 421 illustrated in FIG. 3 are ON.

The image forming apparatus 10 may shift to a state other than the above-described power OFF state, the first sleep state, the second sleep state, and the standby state. Specifically, the image forming apparatus 10 may shift to the suspend state. The suspend state is a state where power is supplied only to certain units of the image forming apparatus 10, i.e., the power source control unit 401 and the RAM 302. In the suspend state, the switch 417 illustrated in FIG. 3 is ON, and the other switches 416, and 418 to 421 are OFF. In the suspend state, the state of the image forming apparatus 10 before shifting to the suspend state is stored in the RAM 302 in which supply of power is maintained. The image forming apparatus 10 can return from the suspend state at high speed by using the state of the image forming apparatus 10 stored in the RAM 302.

Power state transition of the image forming apparatus 10 will be described below with reference to FIG. 4.

When the power switch 416 is turned OFF in the standby state, the image forming apparatus 10 shifts to the power OFF state (refer to (1) illustrated in FIG. 4).

When the power switch 416 is turned ON in the power OFF state, the image forming apparatus 10 shifts to the standby state (refer to (2) illustrated in FIG. 4).

When the power source control unit 401 receives a PDL print job from the external apparatus 20 in the first sleep state or the second sleep state, the image forming apparatus 10 shifts to the standby state (refer to (3) illustrated in FIG. 4).

When the power supply control unit 401 receives a packet on which the LAN controller 306 cannot perform proxy response in the second sleep state, or when any of the buttons 121 of the operation unit 12 is pressed, the image forming apparatus 10 shifts to the first sleep state (refer to (4) illustrated in FIG. 4).

When a predetermined time period has elapsed in a state where the buttons 121 of the operation unit 12 are not operated, and a predetermined time period has elapsed in a state where a PDL print job is not received in the first sleep state, the image forming apparatus 10 shifts to the second sleep state (refer to (5) illustrated in FIG. 4).

When the power saving button 121*c* of the operation unit 12 is pressed in the standby state, the image forming apparatus 10 shifts to the first sleep state (refer to (6) illustrated in FIG. 4).

The power source control unit 401 will be described below.

The power source control unit 401 is a complex programmable logic device (CPLD). The power source control unit 401 controls the image forming apparatus 10 to shift to each of the above-described power states. The power source control unit 401 is supplied with power in the second sleep state, and detects return factors from the second sleep state, such as depression of the buttons 121 of the operation unit 12, and reception of a packet (including a PDL print job) on which the LAN controller 306 cannot perform proxy response. Return factors from the second sleep state are not limited only to the depression of the buttons 121 and the reception of a packet on which the LAN controller 306 cannot perform proxy response. For example, when the image forming apparatus 10 is provided with the FAX function, the power source control unit 401 may return from the second sleep state when a FAX is received.

The power source control unit 401 communicates with the CPU 301, and turns each of the switches 417 to 421 ON or OFF according to instructions from the CPU 301.

The power source control unit 401 receives a Wake signal J from the LAN controller 306. When the power source control unit 401 receives a packet (including a PDL print job) on which the LAN controller 306 cannot perform proxy response via the network 60, the LAN controller 306 outputs the Wake signal J to the power source control unit 401. Upon reception of the Wake signal J, the power source control unit 401 turns ON the switch 421. When the switch 421 is turned ON, the CPU 301 is activated, and analyzes the received packet. When the CPU 301 determines that the received packet is a PDL print job, the CPU 301 outputs the control signal F to the power source control unit 401 so that the switches 418 and 419 are turned ON. Thus, the image forming apparatus 10 shifts to the standby state. When the received packet is a packet on which the LAN controller 306 can perform proxy response by using the information stored in the HDD 304, the power source control unit 401 does not output the control signal F. Therefore, the switches 418 and 419 are not turned ON.

The power source control unit 401 receives a Wake signal I from any one of the buttons 121 of the operation unit 12. When the user presses any one of the buttons 121 of the operation unit 12, the operation unit 12 outputs the Wake signal I to the power source control unit 401. Upon reception of the Wake signal I, the power source control unit 401 turns ON the switch 421. When the user presses any one of the buttons 121 of the operation unit 12, the CPU 301 may turn on the display unit 122 of the operation unit 12.

<Operations of Power Source Control Unit 401>

Operations performed by the power source control unit 401 when the image forming apparatus 10 is activated from the power OFF state will be described below with reference to FIG. 6.

When the main switch 416 is turned ON from OFF by a user operation in the power OFF state, the first power supply unit 410 supplies power to the power source control unit 401. When the voltage output from the first power supply unit 410 becomes stable, the first power monitoring unit 413 outputs the power good signal A to the power source control unit 401. In step S502, upon reception of the power good signal A, the power source control unit 401 outputs the control signals F, G, and H to turn ON the switches 418 to 421. Accordingly, power is supplied to the CPU 301, the printer unit 14, and the scanner unit 13. The CPU 301 supplied with power executes activation processing.

Upon reception of a packet on which the LAN controller 306 cannot perform proxy response from the external apparatus 20 in the second sleep state, the power source control unit 401 turns ON the switch 421. Accordingly, power is supplied to the CPU 301. The CPU 301 supplied with power analyzes the received packet. When the CPU 301 determines that the received packet is a PDL print job, the CPU 301 controls the power source control unit 401 to turn ON the switches 418 and 419. Specifically, in step S502, the power source control unit 401 outputs the control signal F to turn ON the switches 418 and 419. Accordingly, power is supplied to the printer unit 14 and the scanner unit 13.

In the present exemplary embodiment, in step S503, the power source control unit 401 determines whether the second power supply unit 411 normally outputs a voltage. When the second power monitoring unit 414 detects that the output voltage of the second power supply unit 411 exceeds the threshold value, the second power monitoring unit 414 outputs the power good signal B to the power source control unit 401. Upon reception of the above-described power good signal B, the power source control unit 401 determines that the second power supply unit 411 normally outputs a voltage (YES in step S503). On the other hand, when the power source control unit 401 cannot receive the power good signal B until a predetermined time period (for example, 14 seconds) has elapsed after the switch 418 is turned ON, the power source control unit 401 determines that the second power supply unit 411 does not normally output a voltage (NO in step S503). The relevant predetermined period is measured by a timer provided in the power source control unit 401.

If the second power supply unit 411 does not normally output a voltage, AC power supplied from the plug P may be unstable when the image forming apparatus 10 returns from the power OFF state or the second sleep state. When supplying power to a high-load device in a state where the relevant AC power is not stable, the output voltage of the second power supply unit 411 may not rise. However, the above-described AC power may become stable after a certain time has elapsed.

In the present exemplary embodiment, when the power source control unit 401 determines that the second power supply unit 411 does not normally output a voltage (NO in step S503), then in step S504, the power source control unit 401 stops the output of the control signal F to turn OFF the switches 418 and 419. Accordingly, the second power supply unit 411 and the third power supply unit 412 stop power supply to the printer unit 14 and the scanner unit 13. The power source control unit 401 turns OFF the switches 418 and 419 until charges accumulated in capacitors of the second power supply unit 411 and the third power supply unit 412 have been discharged. Specifically, when a predetermined period (for example, for 1 second) has elapsed after the switches 418 and 419 are turned OFF (YES in step S505), then in step S506, the power source control unit 401 outputs the control signal F to turn ON the switches 418 and 419. Accordingly, the second power supply unit 411 and the third power supply unit 412 supply power to the printer unit 14 and the scanner unit 13.

When the second power supply unit 411 does not normally output a voltage even from the switches 418 and 419 are turned OFF from ON and then back to ON until a predetermined time period has elapsed (NO in step S507), then in step S508, the power source control unit 401 stops the output of the control signal F to turn OFF the switches 418 and 419. In step S509, the power source control unit 401 outputs an interrupt signal to the CPU 301. Upon reception of the relevant interrupt signal, the CPU 301 ends the processing currently being executed, and executes shutdown processing. Specifically, to normally deactivate each device of the image forming apparatus 10, the CPU 301 ends the application currently being executed by the controller 11. Upon completion of the shutdown processing, the CPU 301 notifies the power source control unit 401 of information indicating that the relevant shutdown processing is completed. Although, in the present exemplary embodiment, the CPU 301 executes the shutdown processing upon reception of the interrupt signal from the power source control unit 401, the present invention is not limited thereto. Before starting the shutdown processing, the CPU 301 may confirm the state of the second power supply unit 411 through communication with the power source control unit 401.

In step S510, the power source control unit 401 determines whether the above-described shutdown processing is completed. When the power source control unit 401 determines that the shutdown processing is completed (YES in step S510), the power source control unit 401 outputs the control signal E to turn OFF the switch 417. The power source control unit 401 performs the determination in step S510 based on the information received from the CPU 301 when the shutdown processing is completed. The power source control unit 401 outputs the control signal K. Accordingly, a voltage is applied to a solenoid (not illustrated), and the main switch 416 is turned OFF.

On the other hand, when the power source control unit 401 determines that the second power supply unit 411 normally outputs a voltage (YES in step S503), then in step S513, the power source control unit 401 determines whether the third power supply unit 412 normally outputs a voltage. When the third power monitoring unit 415 detects that the output voltage of the third power supply unit 412 exceeds the threshold value, the third power monitoring unit 415 outputs the power good signal C to the power source control unit 401. Upon reception of the above-described power good signal C, the power source control unit 401 determines that the third power supply unit 412 normally outputs the voltage (YES in step S513). On the other hand, when the power source control unit 401 cannot receive the power good signal C until a predetermined time period (for example, 14 seconds) has elapsed after the switch 419 is turned ON, the power source control unit 401 determines that the third power supply unit 412 does not normally output a voltage (NO in step S513).

In the present exemplary embodiment, when the power source control unit 401 determines that the third power supply unit 412 does not normally output a voltage (NO in step S513), then in step S514, the power source control unit 401 stops the output of the control signal F to turn OFF the switches 418 and 419. Accordingly, the second power supply unit 411 and the third power supply unit 412 stop power supply to the printer unit 14 and the scanner unit 13. The power source control unit 401 turns OFF the switches 418 and 419 until charges accumulated in capacitors of the second power supply unit 411 and the third power supply unit 412 have been discharged. Specifically, when a predetermined period (for example, for 1 second) has elapsed after the switches 418 and 419 are turned OFF (YES in step S515), then in step S516, the power source control unit 401 outputs the control signal F to turn ON the switches 418 and 419. Accordingly, the second power supply unit 411 and the third power supply unit 412 supply power to the printer unit 14 and the scanner unit 13.

When the third power supply unit 412 does not normally outputs a voltage even from the switches 418 and 419 are turned OFF from ON and then back to ON until a predetermined time period has elapsed (NO in step S517), then in step S518, the power source control unit 401 stops the output of the control signal F to turn OFF the switches 418 and 419. In step S519, the power source control unit 401 outputs an interrupt signal to the CPU 301. Upon reception of the relevant interrupt signal, the CPU 301 ends the processing currently being executed, and executes the shutdown processing. Specifically, to normally deactivate each device of the image forming apparatus 10, the CPU 301 ends the application currently being executed by the controller 11.

In step S520, the power source control unit 401 determines whether the above-described shutdown processing is completed. When the power source control unit 401 determines that the shutdown processing is completed (YES in step S520), then in S521, the power source control unit 401 outputs the control signal E to turn OFF the switch 417. The power source control unit 401 outputs the control signal K. Accordingly, a voltage is applied to a solenoid (not illustrated), and the main switch 416 is also turned OFF.

Figure 9:
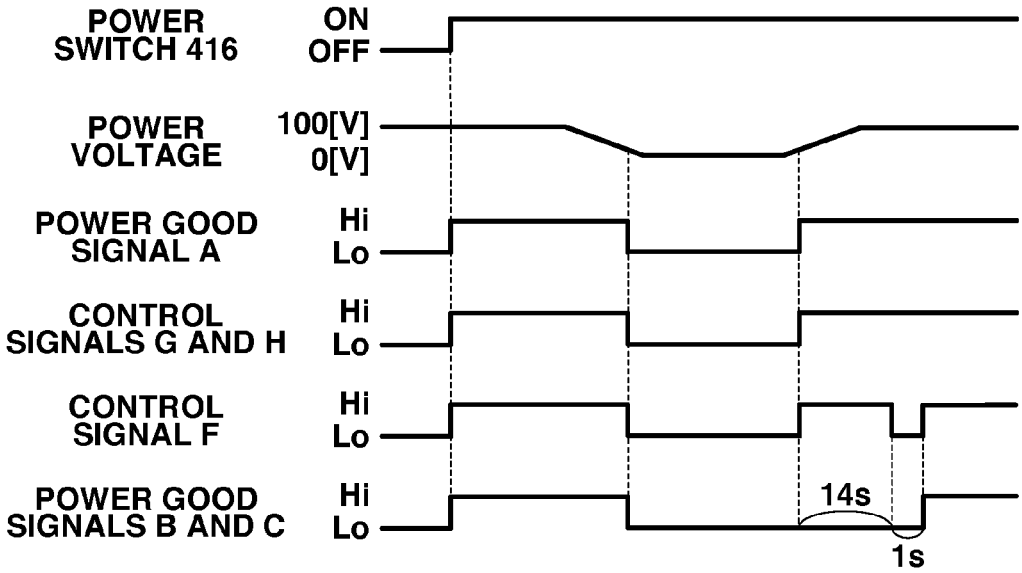
FIG. 9 is a time chart illustrating control signals output from the power source control unit when a power voltage drops.

A control signal output from the power source control unit 401 when the power voltage drops will be described below with reference to FIG. 9. A case where the power voltage supplied from the plug P drops and then becomes stable will be described below.

First of all, when the power switch 416 is turned ON from OFF by a user operation, the power voltage is stable and therefore the first power monitoring unit 413 outputs the power good signal A. When the first power monitoring unit 413 outputs the power good signal A, the power source control unit 401 outputs the control signals F, G, and H. When the power source control unit 401 outputs the control signal H, the first power supply unit 410 supplies power to the CPU 301.

When the power source control unit 401 outputs the control signal F and the switches 418 and 419 are turned ON, the power voltage is stable and therefore the second power monitoring unit 414 and the third power monitoring unit 415 output the power good signals B and C, respectively.

If the power voltage becomes unstable and drops, the voltage monitored by the first power monitoring unit 413 falls below a threshold value, and therefore the first power monitoring unit 413 stops the output of the power good signal A. Accordingly, the power source control unit 401 stops the output of the control signals F, G, and H. Then, the voltages monitored by the second power monitoring unit 414 and the third power monitoring unit 415 fall below a threshold value, and therefore the second power monitoring unit 414 and the third power monitoring unit 415 stop the output of the power good signals B and C, respectively.

When the power voltage rises after a brief interval, the voltage monitored by the first power monitoring unit 413 exceeds a threshold value, and therefore the first power monitoring unit 413 outputs the power good signal A. When the first power monitoring unit 413 outputs the power good signal A, the power source control unit 401 outputs the control signal F, G, and H. When the first power monitoring unit 413 outputs the power good signal A, the first power supply unit 410 can supply power for driving devices of the first power supply system (such as the CPU 301). However, the power voltage has not risen to such a level that power can be supplied to the printer unit 14 and the scanner unit 13. Therefore, the second power monitoring unit 414 and the third power monitoring unit 415 do not output the power good signals B and C, respectively. In this case, protection circuits of the second power supply unit 411 and the third power supply unit 412 detect an overcurrent. Then, the relevant protection circuits respectively interrupt power output from the second power supply unit 411 and the third power supply unit 412. Therefore, a state where the power good signals B and C are not output continues. In the present exemplary embodiment, when the power source control unit 401 cannot receive the power good signals B and C until a predetermined time period (for example, 14 seconds) has elapsed after the control signal F is output, the power source control unit 401 stops the output of the control signal F. Then, after a predetermined time period (for example, 1 second) has elapsed, the power source control unit 401 outputs the control signal F. In this case, the output of the control signals G and H is maintained.

When the power source control unit 401 resumes the output of the control signal F once stopped, the state where the power good signals B and C are not output is canceled. When the power source control unit 401 outputs the control signal F and the switches 418 and 419 are turned ON, the power voltage is stable and therefore the second power monitoring unit 414 and the third power monitoring unit 415 output the power good signals B and C, respectively.

In the above-described first exemplary embodiment, when the voltage (second output voltage) output from the second power supply unit 411 does not rise, the second power supply unit 411 once stops power supply. Then, after a predetermined period has elapsed, the second power supply unit 411 resumes power supply. When power supply from the second power supply unit 411 is turned OFF and then back to ON in this way, power supply from the second power supply unit 411 may become stable.

In the first exemplary embodiment, when the voltage output from the third power supply unit 412 (second output voltage) does not rise, the third power supply unit 412 once stops power supply. Then, after a predetermined period has elapsed, the third power supply part 412 resumes power supply. When power supply from the third power supply unit 412 is turned OFF and then back to ON in this way, power supply from the third power supply unit 412 may become stable.

In the first exemplary embodiment, when the voltage output from the second power supply unit 411 or the third power supply unit 412 is not stable, the power output from the second power supply unit 411 and the third power supply unit 412 is interrupted, but power supply to the CPU 301 is maintained. Thus, the CPU 301 can continuously execute processing, such as activation processing, even while the power output from the second power supply unit 411 and the third power supply unit 412 is interrupted. As a result, the image forming apparatus 10 becomes operative within a shorter time interval than a case where power supply to the CPU 301 is stopped (a case where the CPU 301 executes basic input/output system (BIOS) and operating system (OS) activation processing).

In the first exemplary embodiment, while the CPU 301 waits until the output voltages from the second power supply unit 411 and the third power supply unit 412 become stable, the CPU 301 operating on the output voltage from the first power supply unit 410 which is smaller and stable continues processing.

Figure 7:
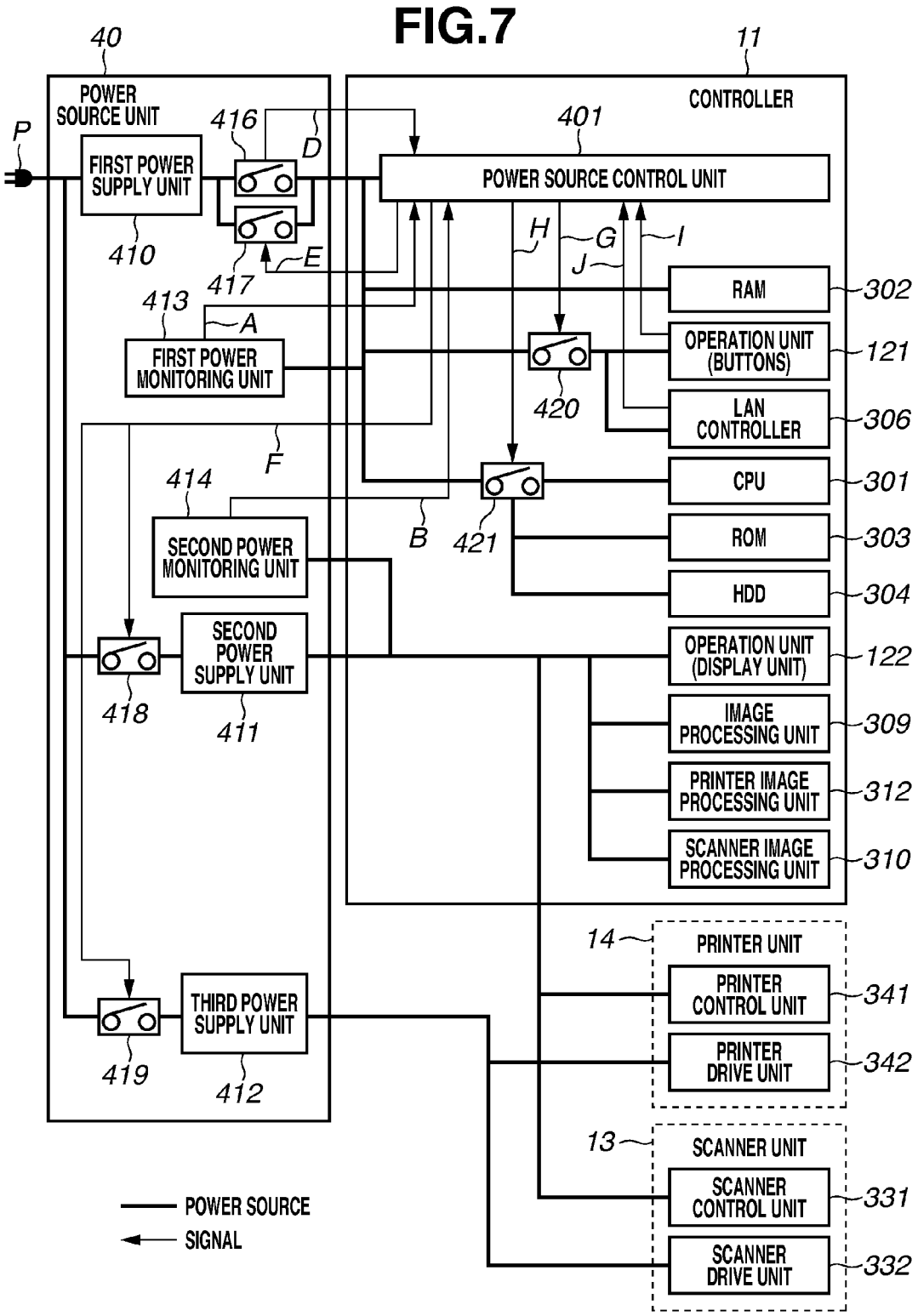
FIG. 7 is a power source circuit diagram of an image forming apparatus according to a second exemplary embodiment.

In the first exemplary embodiment, both the second power monitoring unit 414 for monitoring the output voltage of the second power supply unit 411, and the third power monitoring unit 415 for monitoring the output voltage of the third power supply unit 412 are provided. The second exemplary embodiment will be described below. As illustrated in FIG. 7, an image forming apparatus according to the present exemplary embodiment include the second power monitoring unit 414 for monitoring the output voltage of the second power supply unit 411, but does not include the third power monitoring unit 415 for monitoring the output voltage of the third power supply unit 412.

<Operations of Power Source Control Unit 401>

Figure 8:
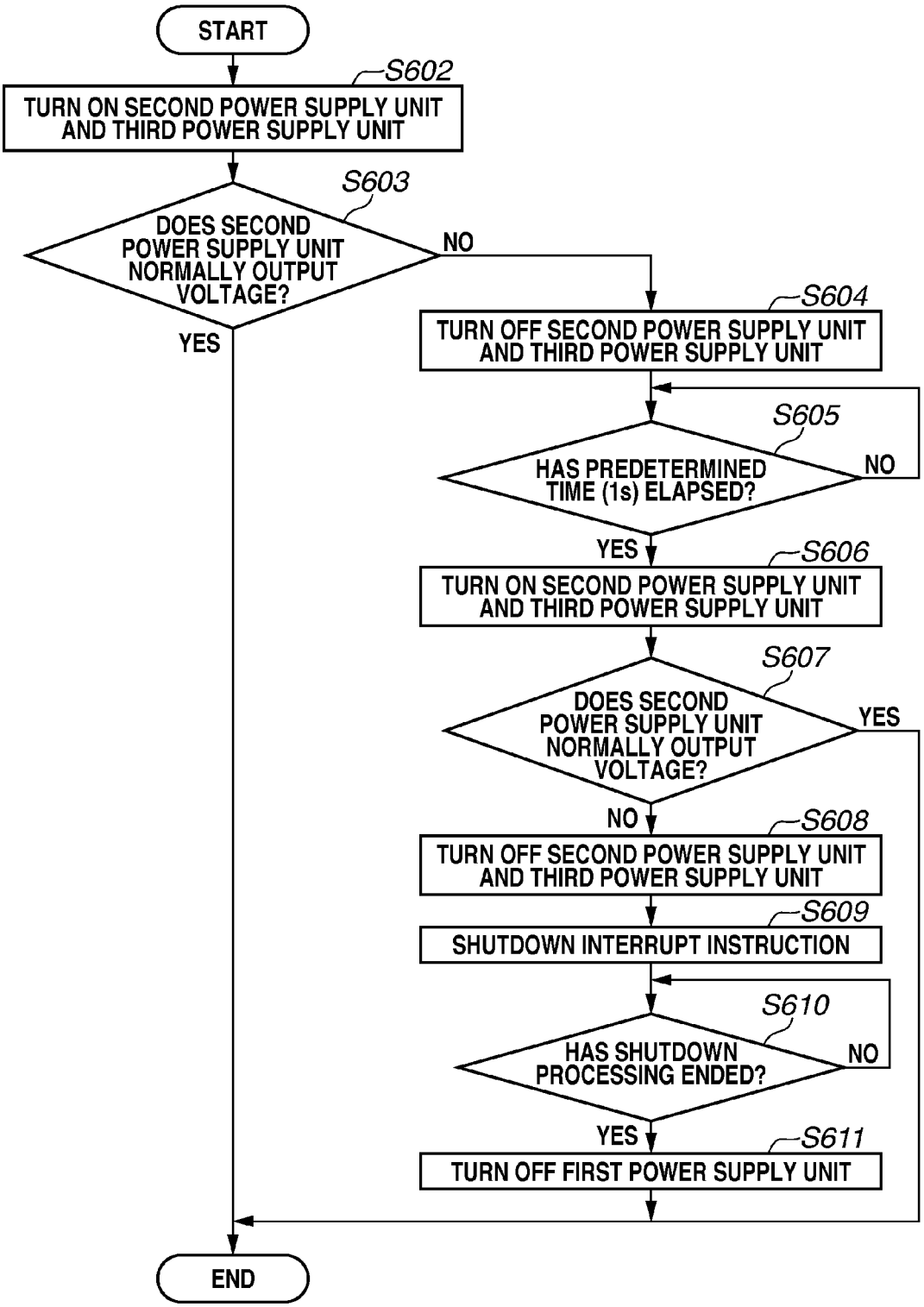
FIG. 8 is a flowchart illustrating processing performed by a power source control unit of the image forming apparatus according to the second exemplary embodiment.

Operations performed by the power source control unit 401 when the image forming apparatus 10 is activated from the power OFF state will be described below with reference to FIG. 8.

When the main switch 416 is turned ON from OFF by a user operation, the first power supply unit 410 supplies power to the power source control unit 401. In step S602, when the voltage of the first power supply unit 410 becomes stable, the power source control unit 401 which is supplied with power outputs the control signals F, G, and H to turn ON the switches 418 to 421. Accordingly, power is supplied to the CPU 301, the printer unit 14, and the scanner unit 13. The CPU 301 supplied with power executes activation processing.

Upon reception of a packet on which the LAN controller 306 cannot perform proxy response from the external apparatus 20 in the second sleep state, the power source control unit 401 turns ON the switch 421. Accordingly, power is supplied to the CPU 301. The CPU 301 supplied with power analyzes the received packet. When the CPU 301 determines that the received packet is a PDL print job, the CPU 301 controls the power source control unit 401 to turn ON the switches 418 and 419. Specifically, in step S602, the power source control unit 401 outputs the control signal F to turn ON the switches 418 and 419. Accordingly, power is supplied to the printer unit 14 and the scanner unit 13.

In the present exemplary embodiment, in step S603, the power source control unit 401 determines whether the second power supply unit 411 normally outputs a voltage.

When the second power monitoring unit 414 detects that the output voltage of the second power supply unit 411 exceeds the threshold value, the second power monitoring unit 414 outputs the power good signal B to the power source control unit 401. Upon reception of the above-described power good signal B, the power source control unit 401 determines that the second power supply unit 411 normally outputs a voltage (YES in step S603). On the other hand, when the power source control unit 401 cannot receive the power good signal B until a predetermined time period (for example, 14 seconds) has elapsed after the switch 418 is turned ON, the power source control unit 401 determines that the second power supply unit 411 does not normally output a voltage (NO in step S603).

In the present exemplary embodiment, when the power source control unit 401 determines that the second power supply unit 411 does not normally output a voltage (NO in step S603), then in step S604, the power source control unit 401 stops the output of the control signal F to turn OFF the switches 418 and 419. Accordingly, the second power supply unit 411 and the third power supply unit 412 stop power supply to the printer unit 14 and the scanner unit 13. The power source control unit 401 turns OFF the switches 418 and 419 until charges accumulated in capacitors of the second power supply unit 411 and the third power supply unit 412 are discharged. Specifically, when a predetermined period (for example, for 1 second) has elapsed after the switches 418 and 419 are turned OFF (YES in step S605), then in step S606, the power source control unit 401 outputs the control signal F to turn ON the switches 418 and 419. Accordingly, the second power supply unit 411 and the third power supply unit 412 supply power to the printer unit 14 and the scanner unit 13.

When the second power supply unit 411 does not normally outputs a voltage even from the switches 418 and 419 are turned OFF from ON and then back to ON until a predetermined time period has elapsed (NO in step S607), then in step S608, the power source control unit 401 stops the output of the control signal F to turn OFF the switches 418 and 419. In step S609, the power source control unit 401 outputs an interrupt signal to the CPU 301. Upon reception of the relevant interrupt signal, the CPU 301 ends the processing currently being executed, and executes the shutdown processing. Specifically, to normally deactivate each device of the image forming apparatus 10, the CPU 301 ends the application currently being executed by the controller 11. Upon completion of the shutdown processing, the CPU 301 notifies the power source control unit 401 of information indicating that the relevant shutdown processing is completed.

In step S610, the power source control unit 401 determines whether the above-described shutdown processing is completed. When the power source control unit 401 determines that the shutdown processing is completed (YES in step S610), then in step S611, the power source control unit 401 outputs the control signal E to turn OFF the switch 417. The power source control unit 401 performs the determination in step S610 based on the information received from the CPU 301 when the shutdown processing is completed. The power source control unit 401 also applies a voltage to a solenoid (not illustrated) to turn OFF the main switch 416.

On the other hand, when the power source control unit 401 determines that the second power supply unit 411 normally outputs a voltage (YES in step S603), the power source control unit 401 waits until any power state transition factor is detected.

<Other Exemplary Embodiments>

While the present invention has specifically been described based on preferable exemplary embodiments, the present invention is not limited thereto but can be modified in diverse ways without departing from the spirit and scope thereof. Further, parts of the above-described exemplary embodiments may be suitably combined.

In the above-described exemplary embodiments, in a case where the output voltage of the first power supply unit 410 or the output voltage of the second power supply unit 411 is low when the switches 418 and 419 are turned ON, the switches 418 and 419 are once turned OFF and then back to ON. When the output voltage of the first power supply unit 410 or the output voltage of the second power supply unit 411 is still low, the CPU 301 executes the shutdown processing. Specifically, in the first exemplary embodiment, the CPU 301 executes the shutdown processing when the voltage is not normally output even after the switches 418 and 419 are turned OFF and then back to ON once. The present invention is not limited thereto. The CPU 301 may execute the shutdown processing when an abnormal output voltage occurs even after the switches 418 and 419 are turned OFF and then back to ON several times.

Figure 6:
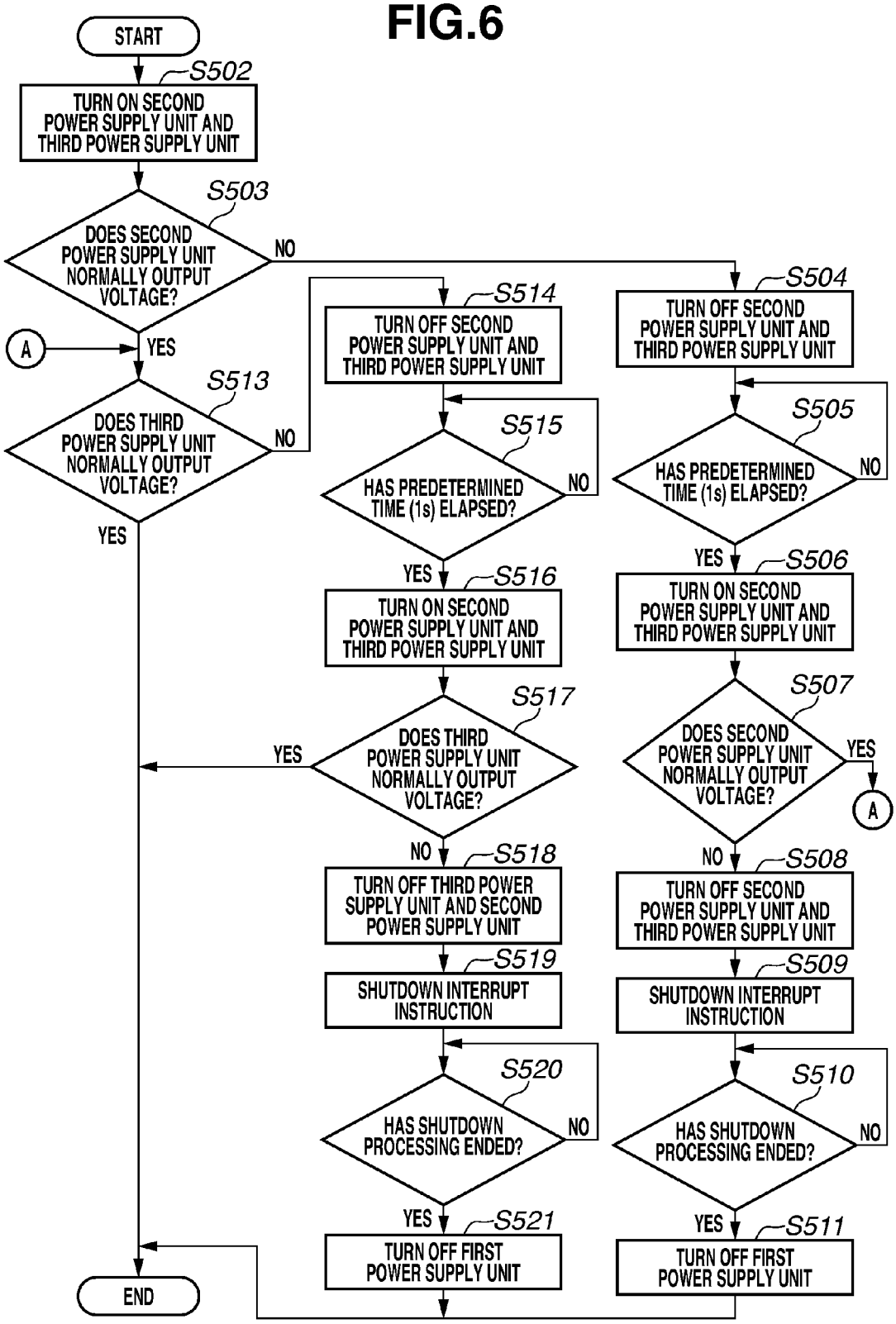
FIG. 6 is a flowchart illustrating processing performed by a power source control unit.

In the above-described exemplary embodiments, the power source control unit 401 of a hardware logic circuit, executes each step of the flowchart illustrated in FIG. 6. The present invention is not limited thereto. The power source control unit 401 may perform each step of the flowchart illustrated in FIG. 6 by executing a program.

Functions illustrated in the flowchart according to the present exemplary embodiment can be implemented when a processing unit (CPU or processor), such as a personal computer, executes software (program) acquired via a network or various storage media.

<Other Embodiments>

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

a first power supply unit configured to supply first output power;

a second power supply unit configured to supply second output power;

a switching unit disposed on an input side of the second power supply unit;

a monitoring unit configured to monitor the second output power supplied by the second power supply unit;

a power source control unit configured to turn the switching unit ON or OFF; and a control unit supplied with the first output power, and configured to control the image forming apparatus, wherein, based on the second output power monitored by the monitoring unit having been lower than a threshold value since the switching unit is turned ON, the power source control unit turns the switching unit OFF and then turns back to ON in a state where the first output power is supplied to the control unit.

2. The image forming apparatus according to claim 1, wherein, the power source control unit turns the switching unit OFF and then, after a predetermined time period has elapsed, turns back to ON.

3. The image forming apparatus according to claim 2, wherein, based on the second output power monitored by the monitoring unit being lower than the threshold value once again after the power source control unit turns the switching unit OFF and then turns back to ON, the control unit performs shutdown processing of the image forming apparatus.

4. The image forming apparatus according to claim 1, wherein, when the second output power monitored by the monitoring unit is higher than a threshold value, the monitoring unit outputs a predetermined signal to the power source control unit as the result of the monitoring.

5. The image forming apparatus according to claim 4, wherein, when the predetermined signal is received before a predetermined time period has elapsed after the switching unit is turned ON, the power source control unit does not turn the switching unit OFF, and wherein, when the predetermined signal is not received from the switching unit is turned ON before the predetermined time period has elapsed, the power source control unit turns the switching unit OFF and then turns back to ON.

6. The image forming apparatus according to claim 2, further comprising:

a measuring unit configured to measure time, wherein, when the predetermined time period is measured by the measuring unit, the power source control unit turns ON the switching unit.

7. The image forming apparatus according to claim 1, wherein the power supply unit supplies second DC output power by using input AC power.

8. The image forming apparatus according to claim 1, further comprising:

a third power supply unit configured to supply a third output power to a printer unit for forming an image on a sheet or a scanner unit for reading a document image.

9. The image forming apparatus according to claim 8, further comprising:

a device control unit supplied with the second output power and configured to control operations of the printer unit or the scanner unit.

10. The image forming apparatus according to claim 1, wherein the power source control unit is a.

11. The image forming apparatus according to claim 1, further comprising:

a display unit supplied with the second output power and configured to display information of the image forming apparatus.

12. The image forming apparatus according to claim 8, further comprising:

another switching unit disposed on an input side of the third power supply unit;

wherein, based on the second output power monitored by the monitoring unit having been lower than a threshold value since the switching unit is turned ON, the power source control unit turns the switching unit and the another switching unit OFF and then turns back to ON in a state where the first output power is supplied to the control unit.

* * * * *